United States Patent [19]

Tsukumo

[11] 4,185,738

[45] Jan. 29, 1980

[54] GUIDING DEVICE FOR ENDLESS APRON

[75] Inventor: Zenzaburo Tsukumo, No. 11-7, Masumi-cho, Ikeda-shi, Osaka-fu, Japan

[73] Assignees: Zenzaburo Tsukumo; NTN Toyo Bearing Company, Limited, both of Osaka, Japan

[21] Appl. No.: 851,173

[22] Filed: Nov. 14, 1977

[51] Int. Cl.[2] ..... B65G 15/62; B65G 23/44

[52] U.S. Cl. ..... 198/814; 198/841

[58] Field of Search ..... 198/806, 813, 814, 841; 74/242.8, 242.11 R, 242.11 S, 242.12, 242.14 R

[56] References Cited

U.S. PATENT DOCUMENTS

| | | | |
|---|---|---|---|
| 2,413,265 | 12/1946 | Thompson | 198/814 |
| 2,753,039 | 7/1956 | Velten et al. | 198/814 |
| 3,115,236 | 12/1963 | Anetsberger | 198/841 X |

FOREIGN PATENT DOCUMENTS

| | | | |
|---|---|---|---|
| 1154762 | 9/1963 | Fed. Rep. of Germany | 198/813 |

OTHER PUBLICATIONS

Sozio, R., "Tractor Chain Tensioner", *IBM Technical Disclosure Bulletin,* vol. 16, No. 1, Jun., 1973.

*Primary Examiner*—James L. Rowland
*Attorney, Agent, or Firm*—Armstrong, Nikaido, Marmelstein & Kubovcik

[57] ABSTRACT

A device for balancing, tightening, and guiding an endless apron in the drafting part of a spinning frame comprised of a base plate in the shape of an angle bar with acute angle having a guiding element on one side thereof, a sliding base equipped with an automatic balancing and tightening mechanism on its lower end which is guided by the above said guiding element, and integrally incorporating thereinto a plate spring having a spring latch. A pressing element is provided between the sliding base and the back surface of the base plate, and a locking lever is slidably disposed at right angles to the guiding element.

9 Claims, 25 Drawing Figures

Fig. 3a
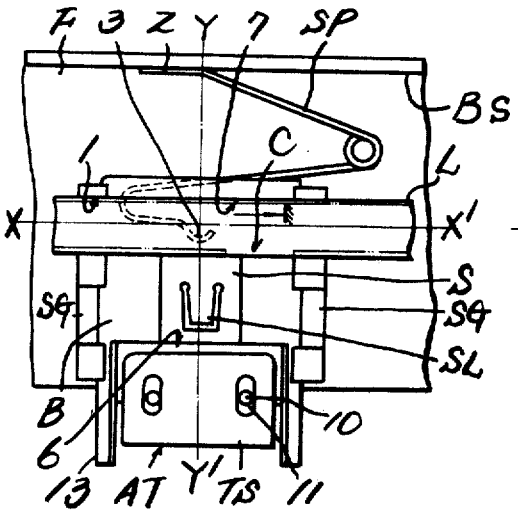
Fig. 3b
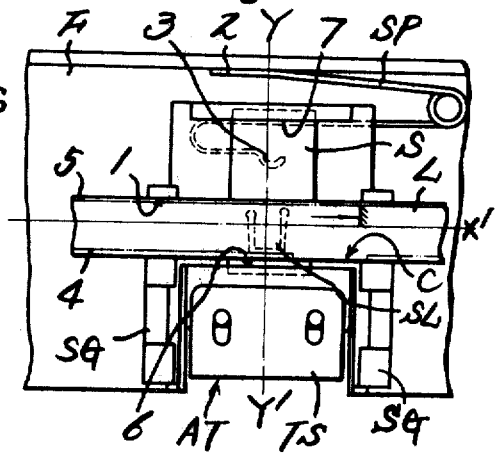
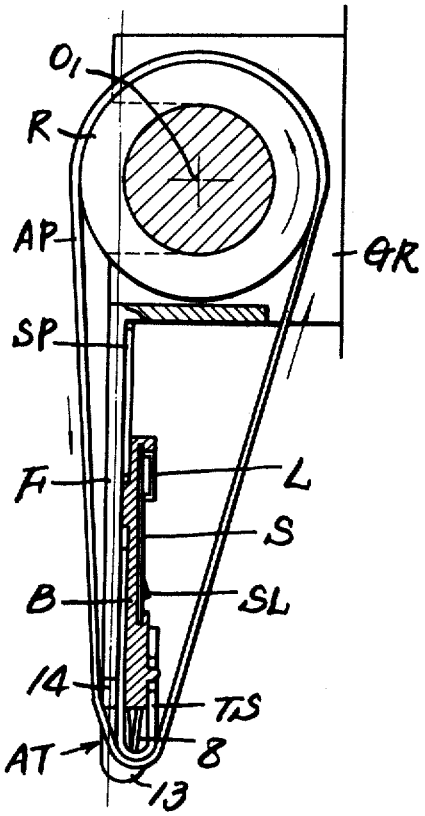
Fig. 10a
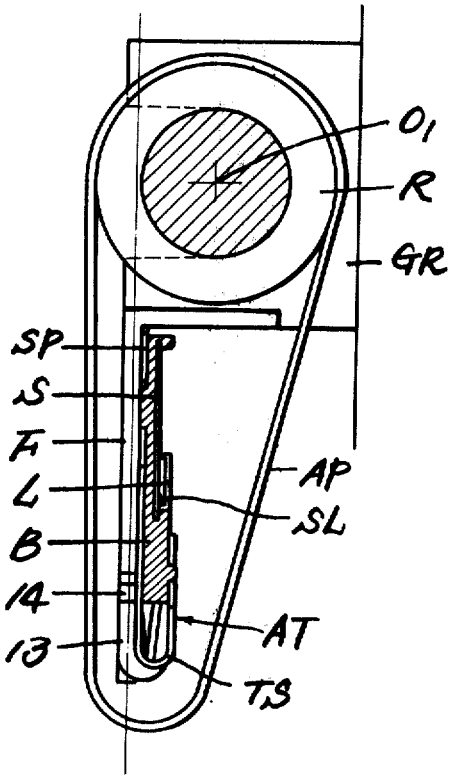
Fig. 10b (e)

(f)

GUIDING DEVICE FOR ENDLESS APRON

BACKGROUND OF THE INVENTION

1. Field of the Invention

This invention primarily relates to a guiding means for an endless apron provided in the drafting part of a spinning frame, and further, to a guiding means for an endless belt in the feeding mechanism of, for example, a printing machine, duplicator, precision packaging machine, film processor, and the like.

2. Description of the Prior Art

FIG. 1 is an illustration showing a typical apron zone of a long apron type drafting device which comprises such components as a bottom roller BR and a top roller TR, both being disposed on a roller stand RS which supports a roller, a cradle CR, a tensor bar TB, a tension guide TG pressed by a tension lever TL in the direction of the arrow, a top apron TA and a bottom apron BA, in addition to a weighting arm WA.

However, the above said apron guiding device in respect of performance and operability for tightening, balancing and guiding the bottom apron, as well as performance of the tensor bar itself and operability in maintenance thereof, has not proved satisfactory.

SUMMARY OF THE INVENTION

This invention relates to an apron guiding device, being provided with a novel mechanism, eliminating disadvantages found in the conventional long apron type, and on the other hand, utilizing advantages thereof, which comprises a base plate having a guide means on one side of an angle bar with acute angle, a sliding base guided by the guide means, an automatic apron balancing and tightening means provided on the end of said sliding base, and a pressing means provided between a back surface of the sliding base and the base plate.

The apron guiding device according to the present invention has been able to enhance increasingly the function and capability of apron guiding devices by eliminating the various drawbacks in the existing devices and, further, adding an automatic apron balancing and tightening means thereto.

BRIEF DESCRIPTION OF THE DRAWINGS

FIG. 2*a* showing an open state and FIG. 2*b* showing a closed state.

FIGS. 3*a* and 3*b* illustrate plan views corresponding to FIGS. 2*a* and 2*b*; FIG. 3*a* showing an open state and FIG. 3*b* showing a closed state;

FIG. 9*a* showing an open state and FIG. 9*b* a closed one;

FIGS. 10*a* and 10*b* illustrate modifications of the embodiments in FIGS. 9*a* and 9*b*, FIG. 10*a* showing an open state and 10*b* showing a closed one;

DETAILED DESCRIPTION OF THE PREFERRED EMBODIMENT

Figure 1:
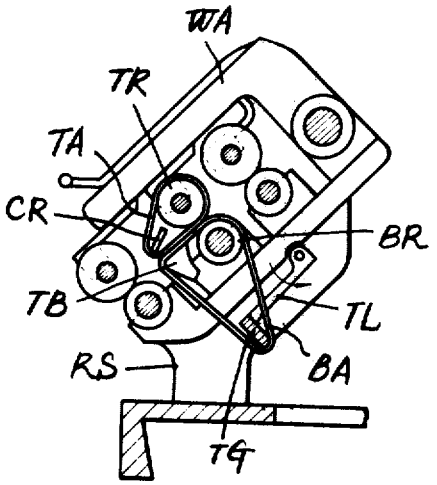
Fig. 1 PRIOR ART
FIG. 1 is an illustration showing a typical apron zone of the long apron type drafting device in a spinning frame.

In FIGS. 2 and 3, the sliding base B is provided with a guiding means AT for automatically balancing, tightening and guiding the apron at the lower end thereof, and in addition, integrally incorporating a plate spring S forming a spring latch SL at the middle part of the surface thereof. The sliding base B is held between a pair of slide guides SG and is slidable only along the line Y—Y', the slide guides being provided on the surface of a base plate F which is shaped like an angle bar with acute angle and adapted to provide a surface SR for movement of the sliding base.

A locking lever L is provided which is channel-shaped (⊓) in section and guided through a pair of guide grooves 1,1 provided in the pair of said slide guides SG so as to be slidable only along the axis X—X' at right angles to the axis Y—Y'. The locking lever L is supported in such a way that it is in contact with the upper surface of the sliding base incorporating the plate spring S and is adapted to be capable of, when required, catching and holding the spring latch SL inside the ⊓-shaped channel part thereof. Sliding of the locking lever L is controlled within a fixed range by an appropriate device not shown herein. A pressing spring SP, which presses the sliding base B toward the lower side of the drawing, lies between the backside of the sliding base B and the back surface BS of the base plate F in such a state as expanding its ends toward the spring-touching surfaces 2 and 3 of both the base plate and the sliding plate, respectively. This spring may be replaced, when required, with either pneumatic, hydraulic, magnetic or electric pressing means. On the upper surface of the sliding base B are formed upwardly protruding flanges 6 and 7 facing respective hanging sides 4 and 5 of the locking lever L. The hanging sides 4 and 5 occupy a position between the protruding flanges 6 and 7 and limit the range of sliding distance of the sliding base B. In other words, movement of the sliding base B along the axis Y—Y' is limited in the upward direction by contact of the lower flange 6 with the locking lever or bar L, and, similarly, downward sliding movement is limited by contact of the upper flange 7 with the same lever L.

Figure 2A:
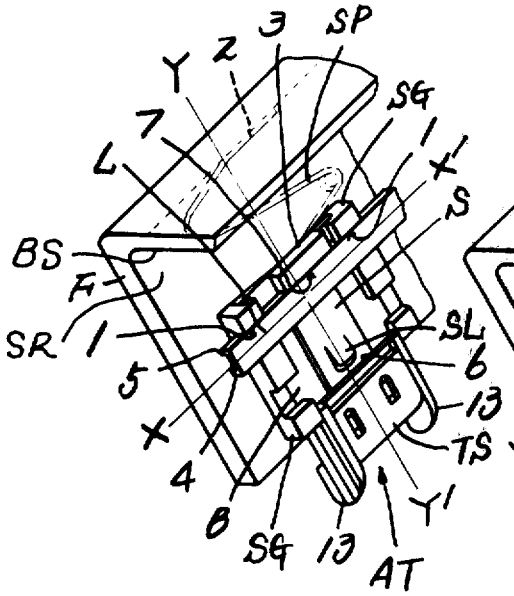
FIGS. 2*a* and 2*b* illustrate perspective views of the relationship between the base plate, sliding plate and locking lever, all of which comprise the main part of the device according to the invention.
Figure 2B:
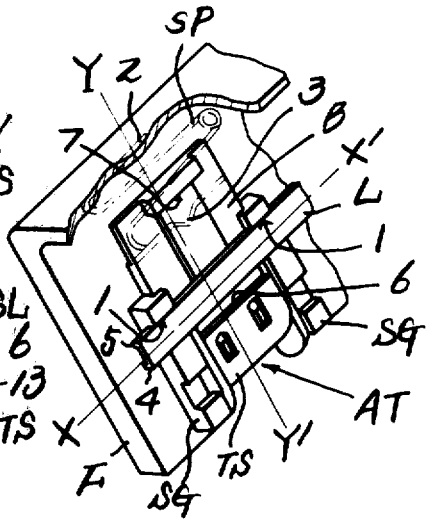

FIGS. 2*a* and 3*a* show the sliding base B protruded from the base plate F, i.e., the apron is tightened, wherein the spring latch SL of the plate spring S incorporated in the sliding base B lies outside the channel of the locking lever L. FIGS. 2*b* and 3*b* show the sliding base B drawn back into the base plate F thereby compressing the pressing spring SP, i.e., the apron is loosened, wherein the spring latch SL lies inside the channel of the locking lever L, being withheld by the hanging side 4 of the locking lever L and, therefore, keeping the sliding base B withdrawn. A cut part C is provided in the hanging side 4 of the locking lever L, allowing the spring latch to pass therethrough. In the position shown in FIG. 3*b*, by shifting the locking lever L to the left side, the cut part C of the locking lever L is brought into alignment with the spring latch SL, and the sliding base B is permitted to assume the position shown in FIGS. 2*a* and 3*a* under the action of the pressing spring SP as discussed above. After the sliding base B protrudes from the base plate, the locking lever L is shifted to the right. As shown in FIG. 3*a*, by thrusting the sliding base B along the axis Y—Y' against resilience of the pressing spring SP, the spring latch SL passes beneath the bottom end of the hanging side 4 and is withheld therein.

Figure 4A:
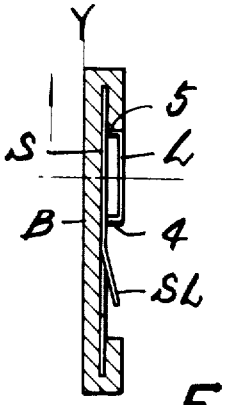
FIGS. 4*a*, 4*b*, 4*c*, 4*d*, 4*e* and 4*f* illustrate changes in positional relationship between the spring latch of the sliding base and the locking lever.
Figure 4B:
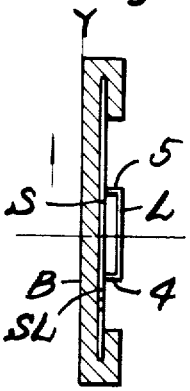
Figure 4C:
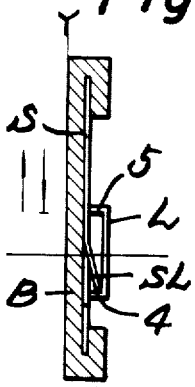

FIGS. 4*a*,4*b*,4*c*,4*d*,4*e* and 4*f* show changes in the positional relationship between the locking lever L and the spring latch SL. In the position shown in FIG. 4*d*, where the guiding means is functioning in a normal state, if the sliding base B is thrust upwardly against the pressing spring SP, the positional relationship between the sliding base B, spring latch SL and locking lever L is progressively changed as shown in FIGS. 4*a*,4*b* and 4*c*, where finally the locking lever L is immovably held from movement along the axis Y—Y'. That is, in the position shown in FIG. 4*c*, the spring latch SL is held within the channel by the hanging side 4.

Figure 4D:
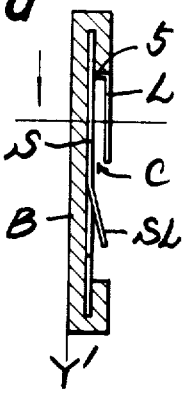
Figure 4E:
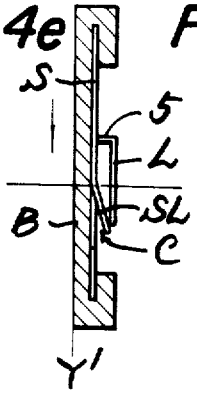
Figure 4F:
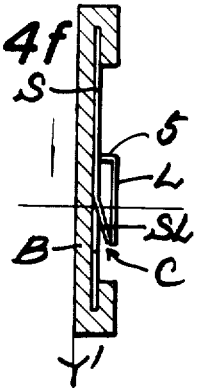
Figure 5:
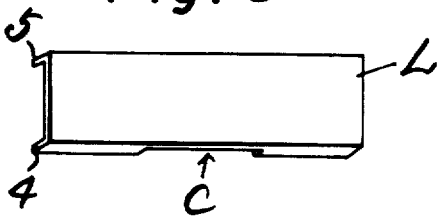
FIG. 5 is a perspective view of the locking lever.

For releasing the latch, displacement of the locking lever L as shown in FIG. 3*f* is necessary. To this end, the locking lever L is shifted to the left as shown in FIG. 3*b* until the cut part C of the locking lever L is aligned with the spring latch SL, thus corresponding to the position illustrated in FIG. 4*f*. After the locking lever L is positioned as shown in FIG. 4*f*, the positional relationship between the sliding base B, spring latch and locking lever is progressively changed as shown in FIGS. 4*d*, 4*e* and 4*f*, wherein the sliding base B returns to its initial state where the guiding means functions normally. So long as the sliding base B remains positioned as shown in FIG. 4*d*, the sliding base B will tighten and guide the apron correctly, offering resistance to compressive force of any nature generated by various types of casual phenomena and exerted upon the pressing spring SP.

Figure 6A:
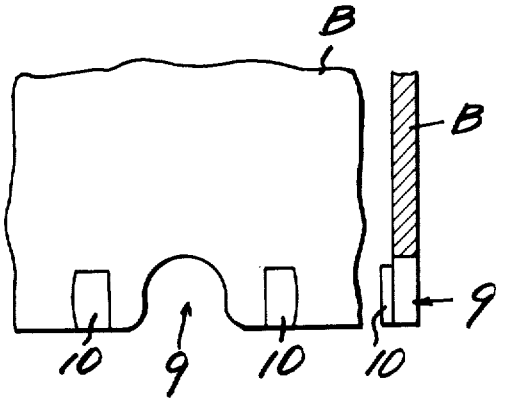
FIGS. 6*a*, 6*b* and 6*c* illustrate the relationship between the sliding base and the tension slider.
Figure 6B:
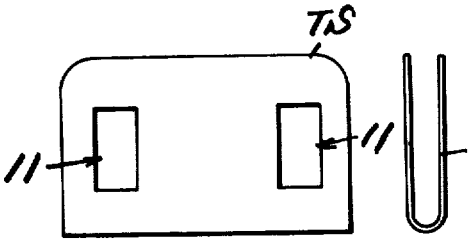
Figure 6C:
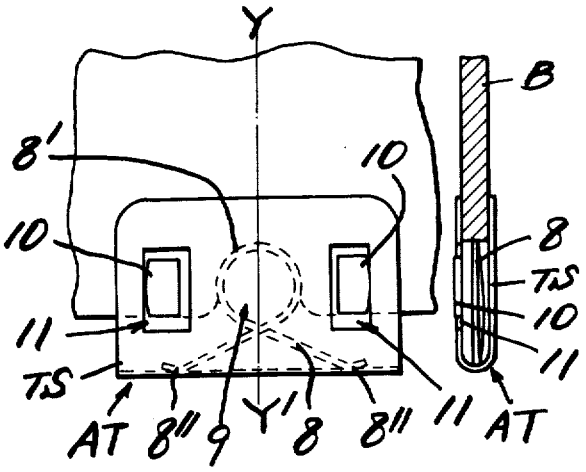

FIGS. 6*a*, 6*b* and 6*c* illustrate a guide means AT for tightening and guiding the endless apron fitted to the tip of the sliding base B. The guide means AT comprises the sliding base B serving as a foundation; a tension slider TS and the spring 8. The tension slider is U-shaped in section, positioned on and extending forwardly from the front end portion of said sliding base B. The spring 8 resiliently urges said tension slider TS from the front end portion of the sliding base B and at the same time supports the tension slider TS rotatably both leftward and rightward. A circular cut-away portion 9 is provided at the middle of the front end of the sliding base B as shown in FIG. 6*a*, and on both sides of the cut-out portion 9 are guiding protuberances 10, 10. The guiding protuberances 10,10 are provided for guiding and controlling sliding movement of the tension slider TS along the axis Y—Y'. FIGS. 6*b* and 6*c* illustrate control holes 11,11 provided on the tension slider TS. The control holes 11,11 come into engagement with the guiding protuberances 10,10 when the slider is coupled with the sliding base B. The spring 8 has a circular portion 8' at a mid-portion thereof, serving as a center of turning in both directions, and expands both ends 8'', 8'' in the left and right directions. Under action of the spring 8, the tension slider TS is kept resiliently extended from the front edge of the sliding base B for balancing, tightening and guiding the apron.

Figure 7:
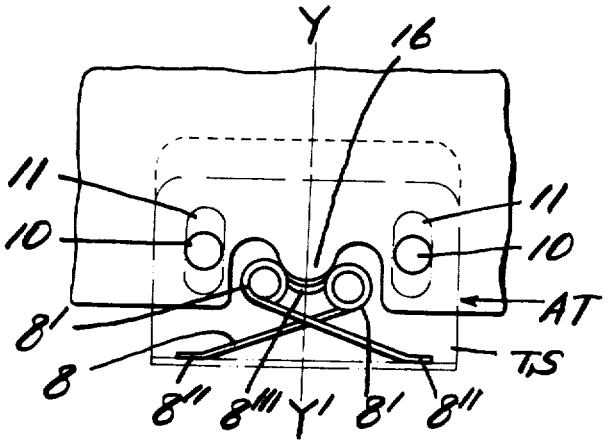
FIG. 7 illustrates a modification of the embodiment of FIGS. 6*a*, 6*b* and 6*c*.

FIG. 7 illustrates a modified embodiment of the guide means AT of the present invention. A semi-circular protuberance 16 is formed at the middle of the cut-away portion 9 provided on the front edge of the sliding base B. A curved portion 8''' is provided between two other curved portions 8' and 8' of the spring 8. The curved portion 8''' is positioned in contact with the outer edge of a protuberance 16 so that the tension slider TS may turn in both directions around the contact part.

Figure 8A:
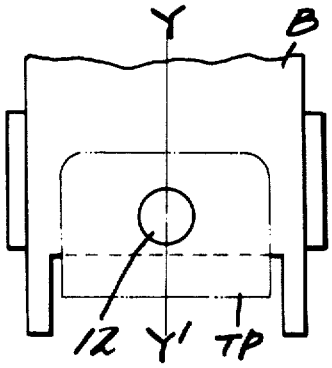
FIGS. 8*a* and 8*b* are plan and elevational views, respectively, illustrating another modification of the embodiment of FIG. 6.
Figure 8B:
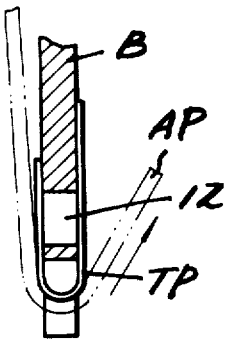

FIG. 8 illustrates a further embodiment of the guide means AT. Sliding movement of the tension slider TS along the axis Y—Y' depends on the sliding function of the sliding base B itself. The tension plate TP is U-shaped in section and positioned on the tip of the sliding base B. The tension plate TP is adapted to be turnable around a rotatable axis 12 for balancing, tightening and guiding the apron.

Figure 9A:
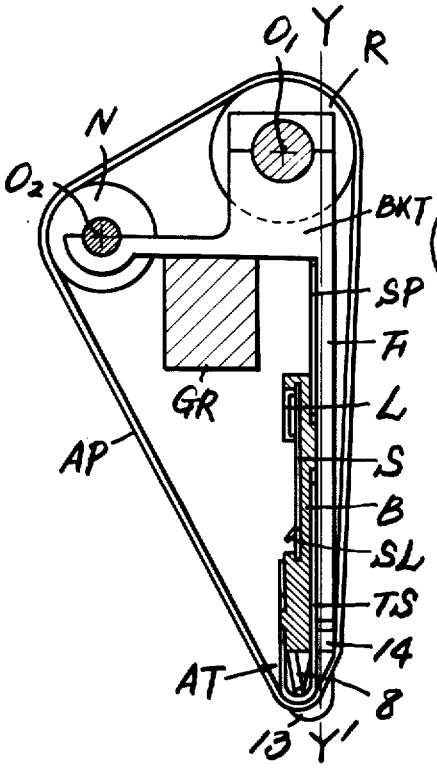
FIGS. 9*a* and 9*b* illustrate the device completely assembled according to this invention.
Figure 9B:
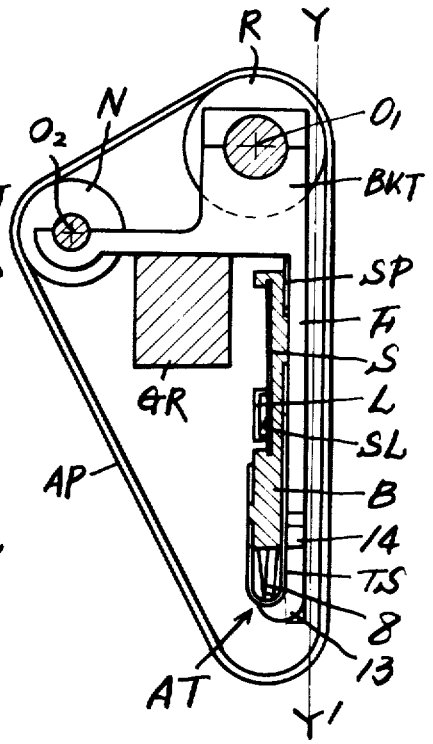

FIG. 9 illustrates a device for guiding the endless apron in the form of a triangle, wherein one end of a bracket BKT is secured to a frame GR. The bracket BKT forms a base plate F which functions as a foundation to which the sliding base is secured. The tension slider TS is mounted onto the tip of the sliding base B, i.e., a point where the apron AP changes its running direction. The apron AP is guided in the form of a triangle and tensioned by a driving roller R that revolves around a center $O_1$ provided on the bracket BKT secured to the frame GR, the guide roller N revolving around $O_2$, and the balancing and tightening means AT. Guiding portions 13 are provided on both sides of the tip of the sliding base B so as to move the apron sideways to be guided to a correct path that extends on both sides of a certain center line. The apron guide 14 is in slight contact with the reverse side of the apron AP and separates the apron from the plate F, thereby mitigating acuteness of angle with which the running direction of the apron is changed and preventing the apron from having a permanent curving tendency as well as from sticking of dust to the reverse side thereof. As shown in FIG. 9*b*, the balancing and tightening means AT at the tip of sliding base B is so constructed as to be received in the cut part of the base plate F when the sliding base B is drawn back into the base plate F and retained at the recessed portion. Therefore, each of a group of aprons that surrounds its respective base plate can freely be handled independent of the balancing means, which permits easy servicing and maintenance of the balancing means.

FIG. 10 illustrates the apron enclosing the driving roller R and the sliding base B including the balancing means AT mounted on the base plate F which is integrally secured to the frame GR.

Figure 11:
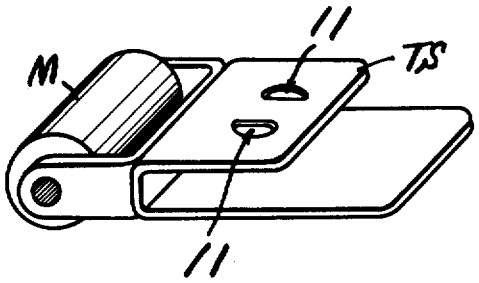
FIG. 11 shows a modification of the tension slider.

FIG. 11 illustrates the tension slider TS to the end of which a guide roller M is secured.

Figure 12:
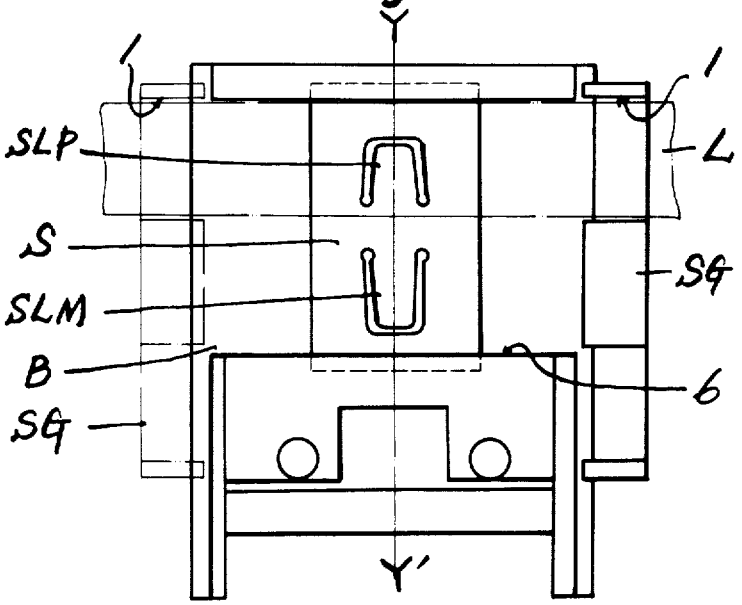
FIG. 12 shows a modification of the latch spring.

FIG. 12 illustrates another embodiment of the spring latch on the spring plate S, wherein an additional spring latch SLP is positioned opposite to and symmetrical with respect to a spring latch SLM for limiting the distance of displacement of the device along the axis Y—Y' during the period of normal operation thereof. In addition, the spring latch SLM serves the same function as that of the spring latch SL. According to this method, an experiment was performed in an attempt to remove the major cause of apron breakage and, as a result, a significant benefit has become apparent therefrom.

Figure 13A:
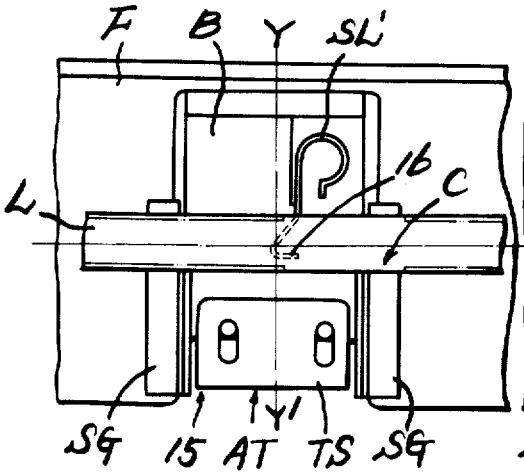
FIG. 13 shows another modification of the latch spring.
Figure 13B:
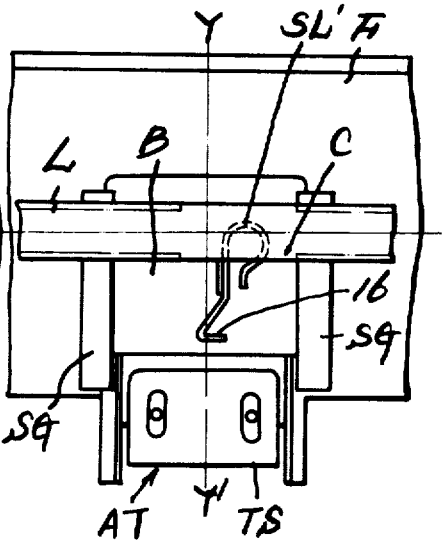

Further, as shown in FIG. 13, latching operation may be performed in a manner similar to the above by mounting a latch spring SL' to the sliding base B and utilizing a hook portion 16 at the tip of the latch spring SL', instead of using the spring plate.

Preferred embodiments of this invention having some characteristics and other currently contemplated modifications have thus far been described as above, and it will be apparent to those skilled in the art that correction and/or modification thereof may be resorted to without departing from the spirit of this invention.

Accordingly, embodiments of this invention as described above are to be considered as describing and not limiting this invention, and therefore, it is to be understood that the scope of this invention is defined in the appended claims, and all modifications included within the spirit and scope equivalent to said claims are intended to be included within said claims.

I claim:

1. A tightening and guiding device for guiding an endless apron smoothly in a predetermined path comprising a base plate having a guide means disposed thereon, a sliding base guided by said guide means, a latch member having a latch spring carried by said sliding base, a pressing means provided between said sliding base and a back surface of said base plate, and a locking bar provided on said guide means and being slidable at right angles to said guide means between two positions, wherein in a first position said locking bar retains said sliding base against the action of said pressing means by blocking said latching spring and in a second position said locking bar permits free movement of said sliding base and said latch spring under the influence of said pressing means.

2. A tightening and guiding device for guiding an endless apron smoothly in a predetermined path comprising a base plate having a guide means disposed thereon, a sliding base guided by said guide means and being equipped with an automatic balancing and tightening means supported on an end of said sliding base, and integrally incorporating a latch member having a latch spring, a pressing means provided between said sliding base and a back surface of said base plate, and a locking bar provided on said guide means, said locking bar being slidable at right angles to said guide means between two positions, wherein in a first position said locking bar retains said sliding base against the action of said pressing means by blocking said latching spring and in a second position said locking bar permits free movement of said sliding base and said latch spring under the influence of said pressing means.

3. A tightening and guiding device for guiding an endless apron as claimed in claim 1 wherein said locking bar includes a cut-out portion, wherein when said locking bar is in the second position said cut-out portion is aligned with said latch spring thereby permitting said latch spring to pass.

4. A tightening and guiding device for guiding an endless apron as claimed in claim 2 wherein said locking bar includes a cut-out portion, wherein when said locking bar is in the second position said cut-out portion is aligned with said latch spring thereby permitting said latch spring to pass.

5. A tightening and guiding device for guiding an endless apron as claimed in claim 2 wherein said automatic balancing and tightening means comprises a tension slider and a tension slider spring, said tension slider spring biasing said tension slider in the same direction that said pressing means biases said sliding base.

6. A tightening and guiding device for guiding an endless apron as claimed in claim 5, wherein said sliding base includes at least one guide protuberance and said tension slider is provided with at least one control opening larger than said guide protuberance, at least one said guide protuberance and said control opening cooperating to guide said tension slider in a fixed reciprocating path.

7. A tightening and guiding device for guiding an endless apron as claimed in claim 6 wherein two guide protuberances and two cooperating control openings are provided.

8. A tightening and guiding device for guiding an endless apron as claimed in claim 5, wherein said tension slider spring includes a circular portion at a mid-portion thereof serving as a center of turning and an end portion on each side of said circular portion, and said sliding base includes a circular cut-away portion, said circular portion being seated in said circular cut-away portion and said end portions on each side of said circular portion press against said tension slider.

9. A tightening and guiding device for guiding an endless apron as claimed in claim 5, wherein said sliding base includes a semi-circular protuberance and a cut-away portion on each side of said semi-circular protuberance, and said tension slider spring includes a central curved portion seated against said semi-circular protuberance and a further curved portion on each side of said central curved portion, said further curved portions being at least partially positioned within each of said cut-away portions, and terminating in a pair of respective end portions, said end portions pressing against said tension slider.

* * * * *